US008042222B2

(12) United States Patent
Behrenswerth et al.

(10) Patent No.: US 8,042,222 B2
(45) Date of Patent: Oct. 25, 2011

(54) VACUUM ATTACHMENT FOR A VACUUM CLEANER

(75) Inventors: Martin Behrenswerth, Hilter (DE); Markus Druecker, Guetersloh (DE); Guenther Ennen, Enger (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 54 days.

(21) Appl. No.: 12/522,488

(22) PCT Filed: Dec. 10, 2007

(86) PCT No.: PCT/EP2007/010726

§ 371 (c)(1),
(2), (4) Date: Jul. 8, 2009

(87) PCT Pub. No.: WO2008/083803

PCT Pub. Date: Jul. 17, 2008

(65) Prior Publication Data

US 2010/0037422 A1 Feb. 18, 2010

(30) Foreign Application Priority Data

Jan. 10, 2007 (DE) ..... 10 2007 002 226

(51) Int. Cl.
*A47L 9/04* (2006.01)

(52) U.S. Cl. ..... 15/380; 15/381; 15/382; 15/383; 15/392

(58) Field of Classification Search ..... 15/364, 15/380, 381, 382, 383, 392; *A47L 9/04*
See application file for complete search history.

(56) References Cited

U.S. PATENT DOCUMENTS

| | | | |
|---|---|---|---|
| 3,204,281 | A | 9/1965 | Lamken et al. |
| 5,551,119 | A | 9/1996 | Worwag et al. |
| 6,463,623 | B2 | 10/2002 | Ahn et al. |
| 6,757,934 | B2 | 7/2004 | Park et al. |
| 6,785,933 | B2 | 9/2004 | Kim et al. |

(Continued)

FOREIGN PATENT DOCUMENTS

| | | |
|---|---|---|
| DE | 1243838 | 7/1967 |

(Continued)

OTHER PUBLICATIONS

International Search Report for PCT/EP2007/010726, mailed on Apr. 1, 2008.

*Primary Examiner* — David Redding
(74) *Attorney, Agent, or Firm* — Leydig, Voit & Mayer, Ltd.

(57) ABSTRACT

A vacuum attachment for a vacuum cleaner including a housing having a vacuum channel. A roller is rotatably and displaceably disposed in a region of the vacuum channel and driveable during a vacuuming operation. The roller includes at least one of bristles and baffle walls configured to be in partial contact with a floor covering during the vacuuming operation. At least one roller magnet is disposed on the roller at least one end thereof. At least one housing magnet is non-rotatably disposed on the housing axially adjacent to the at least one roller magnet and configured to interact with the at least one roller magnet so as to alternately at least one of attract and repel the roller so that the roller performs an oscillatory motion as it rotates.

13 Claims, 3 Drawing Sheets

U.S. PATENT DOCUMENTS 7,293,326 B2 * 11/2007 Hawkins et al. ..... 15/389

FOREIGN PATENT DOCUMENTS

| | | |
|---|---|---|
| DE | 4343432 | 8/1994 |
| DE | 10126354 | 4/2002 |
| DE | 10210862 | 12/2002 |
| DE | 10200346 | 3/2003 |
| FR | 1156373 | 5/1958 |
| GB | 2376876 | 12/2002 |
| JP | 2001245832 | 9/2001 |

* cited by examiner

VACUUM ATTACHMENT FOR A VACUUM CLEANER

CROSS REFERENCE TO RELATED APPLICATIONS

This application is a U.S. National Phase application under 35 U.S.C. §371 of International Application No. PCT/EP2007/010726, filed on Dec. 10, 2007, and claims benefit to German Patent Application No. DE 10 2007 002 226.5, filed on Jan. 10, 2007. The International Application was published in German on Jul. 17, 2008 as WO 2008/083803 A1 under PCT Article 21 (2).

FIELD

The present invention relates to a vacuum attachment for a vacuum cleaner, including a vacuum channel formed on a housing and at least one rotatably mounted roller which is disposed in the region of the vacuum channel and can be driven during the vacuuming operation.

BACKGROUND

German document DE 43 43 432 C2 describes a vacuum attachment for a vacuum cleaner having a rotating brush roller. In that approach, the bristles agitate the pile in the region of the suction mouth to provide effective pick-up of dirt. In the process, the carpet pile is "opened up" as the carpet surface is combed by a bristle bundle in the moving direction of the nozzle, or in the opposite direction, during rotation of the brush roller. However, the bristles are effective only in the direction of rotation of the brush roller.

To improve the cleaning performance of such a vacuum attachment, the attachments described in DE 101 26 354 A1, DE 102 10 862 A1, DE 102 00 346 A1 and DE 12 43 838 Bare designed such that the brush roller and/or its drive is capable of performing an oscillatory motion in an axial direction in addition to its rotation. Various motor or mechanical drives are described in the aforementioned documents.

Japanese document JP 2001 245 832 A, describes a brush roller of a vacuum attachment that can be floatingly supported by magnets.

A vacuum attachment having a rotatably mounted roller is known from GB 2 376 876 A.

SUMMARY

In view of the above, an aspect of the present invention to improve a vacuum attachment of the type mentioned at the outset in a way that simplifies the generation of the oscillatory motion while providing a compact design.

In an embodiment, the present invention provides a vacuum attachment for a vacuum cleaner including a housing having a vacuum channel. A roller is rotatably and displaceably disposed in a region of the vacuum channel and driveable during a vacuuming operation. The roller includes at least one of bristles and baffle walls configured to be in partial contact with a floor covering during the vacuuming operation. At least one roller magnet is disposed on the roller at least one end thereof. At least one housing magnet is non-rotatably disposed on the housing axially adjacent to the at least one roller magnet and configured to interact with the at least one roller magnet so as to alternately at least one of attract and repel the roller so that the roller performs an oscillatory motion as the roller rotates.

BRIEF DESCRIPTION OF THE DRAWINGS

The present invention will be explained in more detail below with reference to an exemplary embodiment and the accompanying drawings, in which.

DETAILED DESCRIPTION

Figure 1:
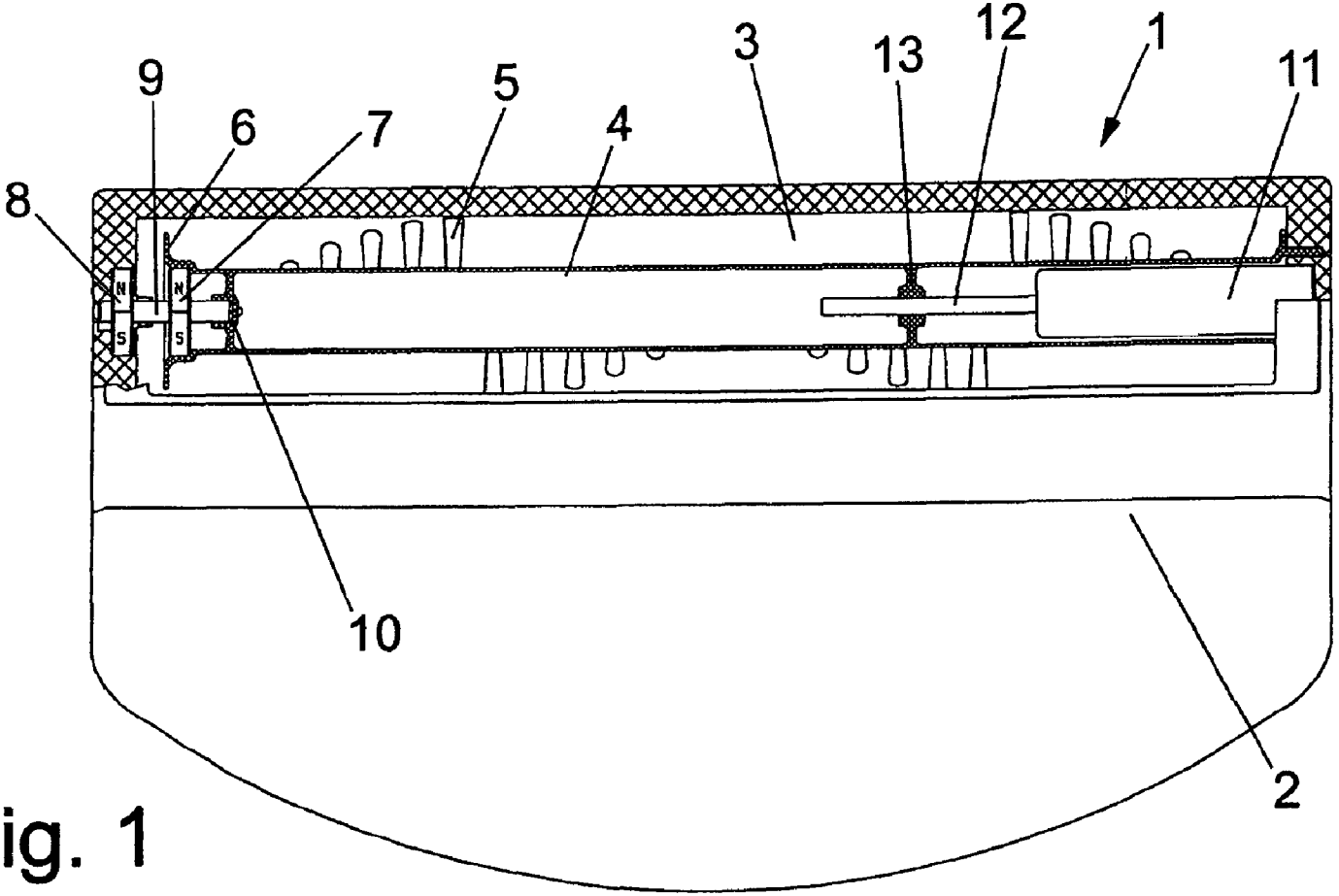
FIG. 1 is a bottom view of a vacuum attachment designed according to the present invention.
Figure 2:
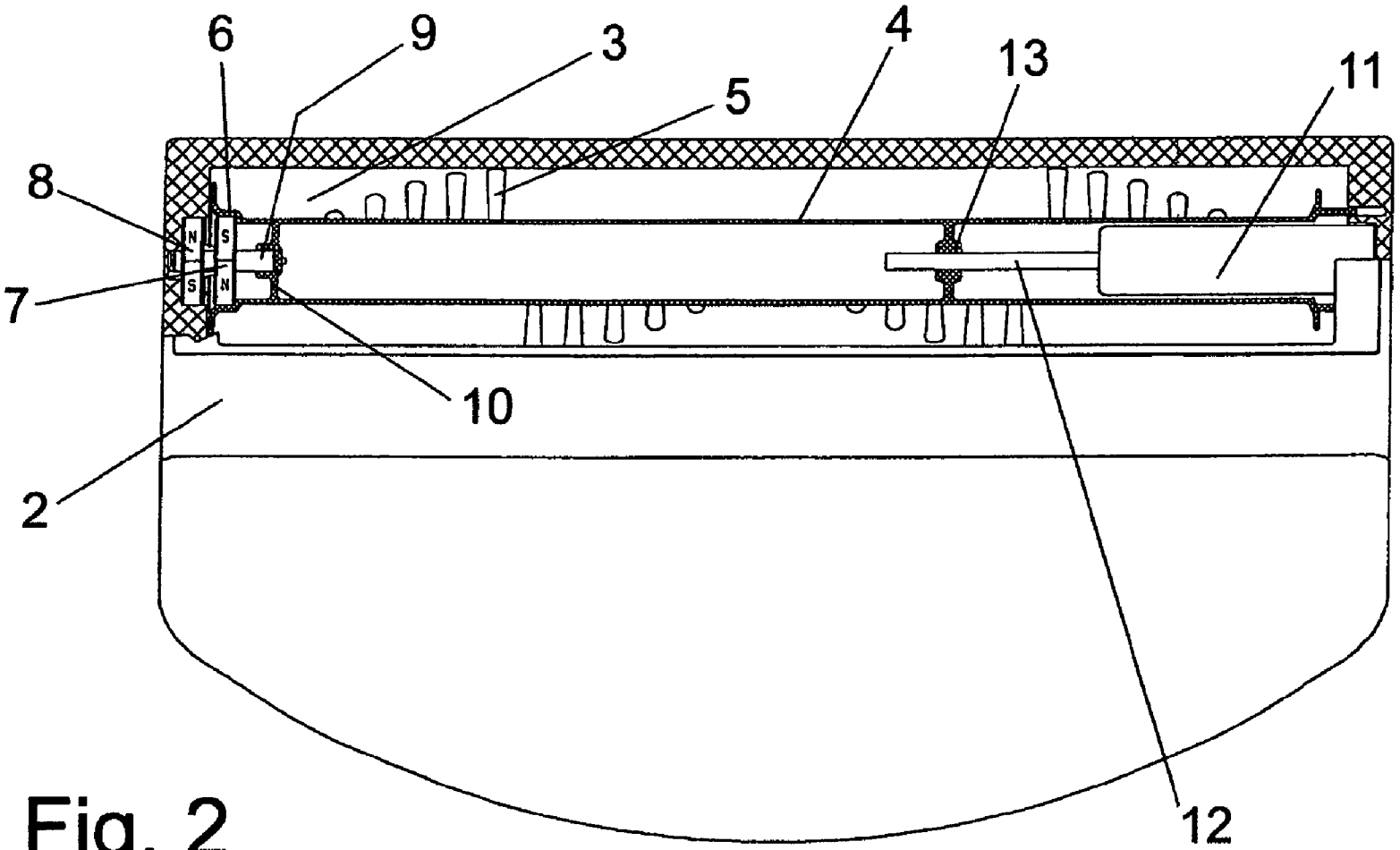
FIG. 2 is a bottom view showing the vacuum attachment of FIG. 1 in a modified position.

The present invention relates to a vacuum attachment for a vacuum cleaner, including a vacuum channel formed on a housing and at least one rotatably mounted roller which is disposed in the region of the vacuum channel and can be driven during the vacuuming operation and which is in partial contact with the floor covering via bristles and/or baffle walls, said roller being displaceably supported and also performing an oscillatory motion as it rotates.

Advantages of the present invention are achieved by providing the roller with magnets to interact with housing-mounted magnets in such a way that the roller is alternately attracted and/or repelled by the magnets as it rotates, thereby generating the oscillatory motion. In this manner, lateral oscillations are generated in a simple and inexpensive way.

According to an embodiment of the present invention, the axle is driven such that it oscillates in an axial direction as it rotates. In this manner, the pile is moved in the direction of rotation of the roller on the one hand, and in a direction perpendicular thereto on the other, so that the pile fibers are raised up in different directions for improved pick-up of dirt. To provide for motion in the axial direction, the roller can be provided with magnets at least at one end thereof, so that, provided the roller is of low weight, a floating support is obtained which operates in a substantially wear-free manner. In order to achieve a compact design, magnets can be held to the roller and, axially adjacent thereto, additional magnets can be non-rotatably mounted to the housing. It is particularly advantageous to use ring-shaped magnets having alternating polarities.

In accordance with another embodiment of the present invention, the roller is capable of performing a beating motion in a perpendicular direction toward the floor as it rotates. In this manner, the pile is beaten by the bristles and/or baffle walls during treatment, resulting in improved pick-up of dirt.

Floating support of the roller can be achieved by providing magnets at opposite ends thereof, and providing stationary magnets adjacent thereto. Rare-earth magnets are particularly suited for this purpose because of their strong magnetic fields.

To achieve effective cleaning, the oscillation of the roller in the axial and/or vertical direction can have an amplitude of, for example, 0.5 mm to 2 mm, preferably of about 1 mm.

A vacuum attachment 1 includes a housing 2 in which is formed a vacuum channel 3. A roller 4 is disposed in a vacuum channel 3 in the region of a suction mouth in the bottom of housing 2, and has bristles 5 fixedly attached thereto and radially projecting therefrom, said bristles being combined into bundles which are arranged in a helical pattern around roller 4.

A ring magnet 7 is fixedly attached to an end portion 6 of roller 4 and is penetrated by an axle 9. Ring magnet 7 has two or four regions of different polarity.

A second ring magnet 8 is non-rotatably held to housing 2 adjacent to ring magnet 7 and is also penetrated by axle 9. Axle 9 is inserted at one end into a receptacle on housing 2, while at the opposite end, it is fixedly attached to a holding portion 10 within roller 4, axle 9 being arranged with play in the region of housing 2.

At the opposite end of housing 2, a drive 11 is mounted within roller 4 and, via a shaft 12, said drive is in engagement with a drive sleeve 13, such that when shaft 12 rotates, roller 4 is rotated via drive sleeve 13, for example at a speed of 2000 to 3000 rpm.

Figure 3:
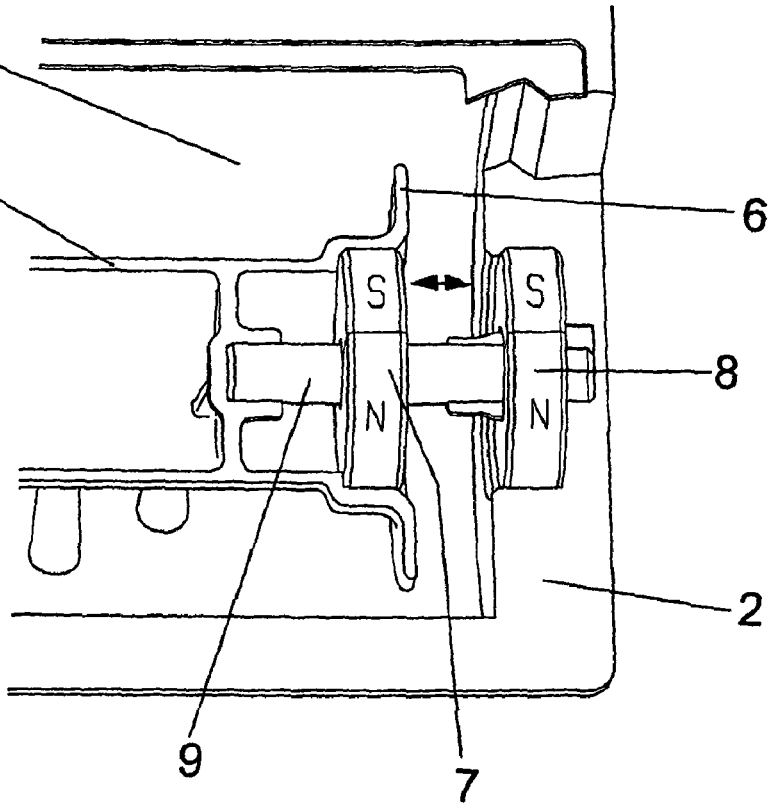
FIG. 3 is a view showing a detail of the vacuum attachment of FIG. 1.
Figure 4:
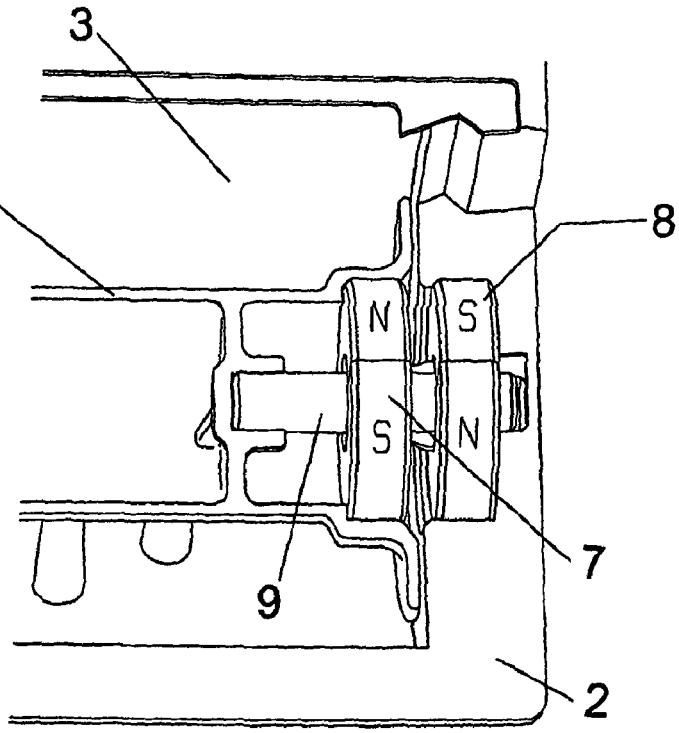
FIG. 4 is a detail view similar to FIG. 3, but showing a changed position.

FIGS. 3 and 4 are detail views illustrating the displaceability of roller 4 relative to housing 2. A ring magnet 7 is non-rotatably fixed to an end portion 6 at each of the opposite ends of roller 4. Ring magnet 7 has regions of different polarity and is disposed adjacent to ring magnet 8, which is non-rotatably attached to housing 2. When regions of the same polarity are adjacent to each other, roller 4 is repelled, so that a gap forms between ring magnets 7 and 8. Since axle 9 is loosely held in ring magnet 8, roller 4 is supported such that it is axially displaceable, but unable to escape in a radial direction.

In a next step, upon further rotation of roller 4 via drive 11, the regions of ring magnets 7 and 8 that are adjacent to each other have different polarities. As a result, ring magnet 7 is attracted toward ring magnet 8 along with roller 4, and the gap between ring magnets 7 and 8 becomes smaller (FIG. 4). In the process, axle 9 is introduced into a receptacle on housing 2 through ring magnet 8.

In vacuum attachment 1, it is possible to provide ring magnets 7 and 8 at only one end of roller 4, or to provide such ring magnets 7 and 8 at opposite ends thereof, in either case providing a suitable support. Ring magnets 7 and 8 have magnets made of rare earths which have strong magnetic fields. The floating support of the roller allows it to oscillate axially in a substantially wear-free manner with little noise.

In the embodiment shown, roller 4 is designed to be displaceable in an axial direction only. Of course, a suitable magnet can also be provided on housing 2 above roller 4 such that during rotation of roller 4, ring magnet 7 causes oscillatory motion in a vertical direction. This enables the roller with its bristles 5 to perform beating motions. It is also possible to superimpose an axial motion and a vertical motion.

What is claimed is:

1. A vacuum attachment for a vacuum cleaner comprising:

a housing including a vacuum channel;

a roller rotatably and displaceably disposed in a region of the vacuum channel and driveable during a vacuuming operation, the roller including bristles configured to be in partial contact with a floor covering during the vacuuming operation, the roller being configured to oscillate in an axial direction as it rotates;

at least one roller magnet disposed or, the roller at at least one end thereof; and at least one housing magnet non-rotatably disposed on the housing axially adjacent to the at least one roller magnet and configured to interact with the at least one roller magnet so as to alternately at least one of attract and repel the roller so that the roller performs an oscillatory motion as the roller rotates.

2. A vacuum attachment for a vacuum cleaner comprising:

a housing including a vacuum channel;

a roller rotatably and displaceably disposed in a region of the vacuum channel and driveable during a vacuuming operation, the roller including bristles configured to be in partial contact with a floor covering during the vacuuming operation;

at least one roller magnet disposed on the roller at at least one end thereof; and at least one housing magnet non-rotatably disposed on the housing axially adjacent to the at least one roller magnet and configured to interact with the at least one roller magnet so as to alternately at least one of attract and repel the roller so that the roller performs an oscillatory motion as the roller rotates, wherein the at least one roller magnet and the at least one housing magnet each include a ring-shaped magnet having alternating polarities.

3. The vacuum attachment as recited in claim 1, wherein the at least one roller magnet and the at least one housing magnet each include a ring-shaped magnet having alternating polarities.

4. The vacuum attachment as recited in claim 1, wherein the at least one roller magnet includes a first roller magnet at a first end of the roller and a second roller magnet at a second end of the roller opposite the first end, wherein the at least one housing magnets include first and second stationary housing magnets, and wherein the first and second roller magnets are disposed adjacent to the respective first and second stationary housing magnets.

5. The vacuum attachment as recited in claim 2, wherein the at least one roller magnet includes a first roller magnet at a first end of the roller and a second roller magnet at a second end of the roller opposite the first end, wherein the at least one housing magnets include first and second stationary housing magnets, and wherein the first and second roller magnets are disposed adjacent to the respective first and second stationary housing magnets.

6. The vacuum attachment as recited in claim 3, wherein the at least one roller magnet includes a first roller magnet at a first end of the roller and a second roller magnet at a second end of the roller opposite the first end, wherein the at least one housing magnets include first and second stationary housing magnets, and wherein the first and second roller magnets are disposed adjacent to the respective first and second stationary housing magnets.

7. The vacuum attachment as recited in claim 1, wherein the at least one roller magnet and the at least one housing magnet include rare-earth magnets.

8. The vacuum attachment as recited in claim 2, wherein the at least one roller magnet and the at least one housing magnet include a rare-earth magnet.

9. The vacuum attachment as recited in claim 1, wherein the oscillatory motion has an amplitude of 0.5 mm to 2 mm.

10. The vacuum attachment as recited in claim 9, wherein the at least one roller magnet and the at least one housing magnet include a rare-earth magnet.

11. The vacuum attachment as recited in claim 2, wherein the oscillatory motion has an amplitude of 0.5 mm to 2 mm.

12. The vacuum attachment as recited in claim 11 wherein the oscillatory motion is at least one of axial and vertical.

13. The vacuum attachment as recited in claim 12, wherein the at least one roller magnet and the at least one housing magnet include a rare-earth magnet.

* * * * *